US006609613B2

(12) United States Patent
Schneider et al.

(10) Patent No.: US 6,609,613 B2
(45) Date of Patent: Aug. 26, 2003

(54) FOIL BAG STACKS, AND METHOD AND DEVICE FOR PRODUCING SUCH BAGS

(75) Inventors: Jakob Schneider, Niederkassel (DE); Werner Brenig, Niederkassel (DE); Armin Meyer, Köln (DE)

(73) Assignee: Lemo Maschinenbau GmbH, Niederkassel-Mondorf (DE)

( * ) Notice: Subject to any disclaimer, the term of this patent is extended or adjusted under 35 U.S.C. 154(b) by 0 days.

(21) Appl. No.: 09/881,378

(22) Filed: Jun. 14, 2001

(65) Prior Publication Data

US 2002/0014433 A1 Feb. 7, 2002

Related U.S. Application Data

(60) Provisional application No. 60/212,025, filed on Jun. 16, 2000.

(30) Foreign Application Priority Data

Jun. 16, 2000 (DE) ..... 100 28 954

(51) Int. Cl.[7] ..... B65D 69/00

(52) U.S. Cl. ..... 206/232; 206/449; 206/806; 206/554

(58) Field of Search ..... 206/232, 554, 206/806, 308.1, 309–312, 449; 383/6, 7, 9, 13, 30, 31

(56) References Cited

U.S. PATENT DOCUMENTS

| | | | | | |
|---|---|---|---|---|---|
| 4,388,958 | A | * | 6/1983 | Dworkin | 229/72 |
| 4,560,068 | A | * | 12/1985 | Membrino | 206/554 |
| 4,566,590 | A | * | 1/1986 | Manning et al. | 206/232 |
| 4,620,630 | A | * | 11/1986 | Moss | 206/45.24 |
| 4,878,580 | A | * | 11/1989 | Johnston | 206/216 |
| 5,709,641 | A | * | 1/1998 | Vaquero | 493/243 |
| 5,826,724 | A | * | 10/1998 | Gebhardt | 206/554 |
| 5,860,905 | A | * | 1/1999 | Bruno | 493/194 |
| 5,941,393 | A | * | 8/1999 | Wilfong, Jr. | 206/554 |
| 6,190,044 | B1 | * | 2/2001 | Fox et al. | 383/9 |
| 6,269,972 | B1 | * | 8/2001 | Smithson | 221/33 |
| 6,395,317 | B1 | * | 5/2002 | Singh et al. | 426/113 |

* cited by examiner

*Primary Examiner*—Shian Luong
(74) *Attorney, Agent, or Firm*—Herbert Dubno

(57) ABSTRACT

Foil bags are formed as new paper bags by fusing together two webs and tying a detachable strap which has a suspension opening to one said opening of each bag, the strap being separated by a perforation line from the respective side of the bag. A pocket is formed at the end of the bag opposite the insertion opening and can have a flap provided with an adhesive strip covered by a masking layer.

7 Claims, 9 Drawing Sheets

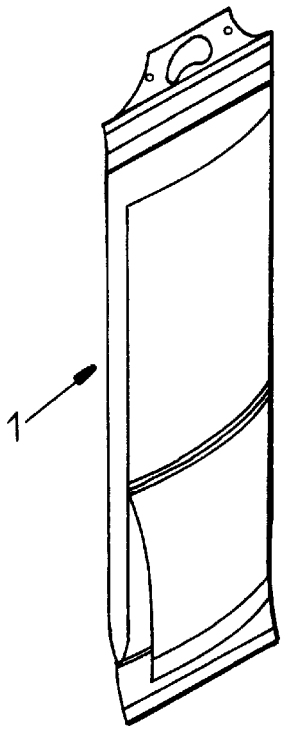
FIG.8
FIG.9
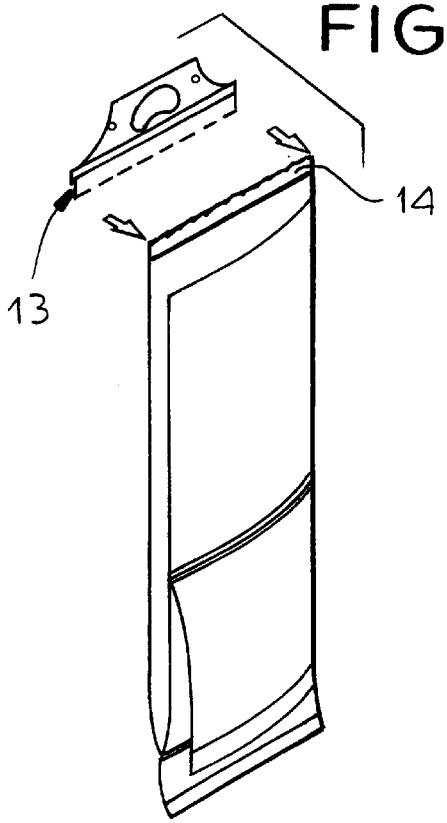
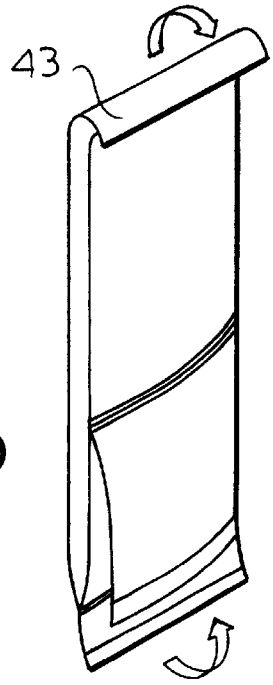
FIG.10

FOIL BAG STACKS, AND METHOD AND DEVICE FOR PRODUCING SUCH BAGS

CROSS REFERENCE TO RELATED APPLICATION

This application is related to provisional application No. 60/212,025 filed Jun. 16, 2000.

FIELD OF THE INVENTION

The invention relates first to a stack of interconnected, elongated bags of plastic foil or film, particularly newspaper bags, with preferably at least one additional pocket and with a suspension element in the area of the insertion opening of the bag, which has at least one suspension opening and which is detachably connected with other bags in the stack.

The invention also relates to the manufacture of such bags and particularly to a method and apparatus for making such bags and pads of such bags.

BACKGROUND OF THE INVENTION

Bags of the mentioned kind are used especially for the extensive protection of newspapers, magazines or the like against weather influences. Frequently these elongated bags have an additional pocket, into which a diskette or the like can be introduced.

As a rule, the bags are assembled in stacks or pads of 10 to 20 pieces, and up to a maximum of 25 pieces and are held together by a grip handle made of cardboard. This grip handle, serving as a suspension element, is fastened with staples or clips to the margin of a tear-off strap.

In practice such a stack is carried along by a delivery person, who first fills the bag with a magazine or newspaper, if this was not previously done, and then tears the filled bag off the stack, in order to deliver it to a place accessible to the recipient.

The use of three different materials, namely cardboard for the grip handle, iron for the staples or clips and plastic material for the actual bag results in considerable recycling expenses, since the mentioned materials have to be collected separately from each other. Besides the production of such bags is quite complicated, so that in practice such bags can be produced only at a cycling speed of approximately 40 to 60 per minute.

OBJECTS OF THE INVENTION

It is the object of the invention to provide a stack of several interconnected elongated bags of plastic foil, particularly newspaper bags, which can be easily transported and handled.

It is also an object to provide a method for the production of such bags which can be interconnected in stacks and which makes possible simple and cost-effective production.

A further object is to provide a device which uses widely known elements and allows the production of the mentioned bags with comparatively high cycling speeds.

SUMMARY OF THE INVENTION

These objects are achieved in accordance with the invention in that the suspension element is formed by a unilaterally projecting tear-off segment of plastic foil. This tear-off segment can for instance be formed by a separate strip fused with the one bag wall in the area of the insertion opening, basically parallel to a perforation line. This insertion opening can be advantageously closed by means of a drawstring or a rain-protection flap.

On the side of the bag opposite to the insertion opening a pocket can be attached and the pocket can have a unilaterally projecting flap at its filling opening which is basically parallel with the insertion opening. The flap can optionally be made in one piece from the pocket material and provided on its inside with an adhesive strip which can be covered with a protective or masking strip.

The connection means for interconnecting the individual bags in the stack can be formed as a interlocking device and, in addition, a strap unwinding mechanism can be provided. Because of the continuous feeding of a strap strip a comparatively high cycling speed can be achieved, for instance of 100 to 125 cycles/minute.

The device can have two fusion separation tools arranged substantially transversely with respect to the direction of the advance motion of the plastic foil or film webs, which move synchronously up and down. The collection mechanism arranged downstream in the direction of the advance motion of the plastic foil webs can have pin-type stacking belts of a pin-type stacker, wherein the bags with the strap strips are taken up by the stacker belts, whereby, until they reach the stacker belts, the bags are held by the pins of the transport belts and are knocked off by a take-down device in the area of the pin-type stacking conveyor, and afterwards are interlocked in the area of the strap.

More particularly, the bag stack can comprise:

a plurality of elongated plastic foil bags each having a pair of opposite sides and formed with an insertion opening through which an article is insertable into the respective bag, one of the sides only of each bag being formed with a suspension element detachable from the respective bag, the suspension elements being interconnected to retain the bags in the stack and being formed with aligned suspension openings proximal to the insertion openings.

The insertion opening can open into elongated pouches shaped to receive a respective newspaper and each of the sides of each of the bags can be formed with the respective pocket separate from the respective pouch. The suspension elements themselves may be separate strips fused to one of the bag walls in the area of the insertion opening substantially parallel to a perforation line between the respective suspension element and bag. The suspension strap or strip can be fused to the inside or outside of the bag walls and each of the bags can be provided with a drawstring or a rain protection flap with an adhesive strip. The pocket may be attached to the end of the bag opposite the insertion opening and can also have a unilaterally projecting flap along a filling opening which is substantially parallel to the insertion opening and through which a computer disk or the like can be inserted into the pocket. The flap can be made in one piece of the same material as the pocket, preferably a transparent film or foil. The pocket flap can be provided along an inner surface with an adhesive strip which can, if desired, be covered by a protective or masking strip.

BRIEF DESCRIPTION OF THE DRAWING

The above and other objects, features, and advantages will become more readily apparent from the following description, reference being made to the accompanying drawing in which:

FIGS. 6 to 10 are perspective views showing further modified embodiments of the bag.

SPECIFIC DESCRIPTION

Figure 1:
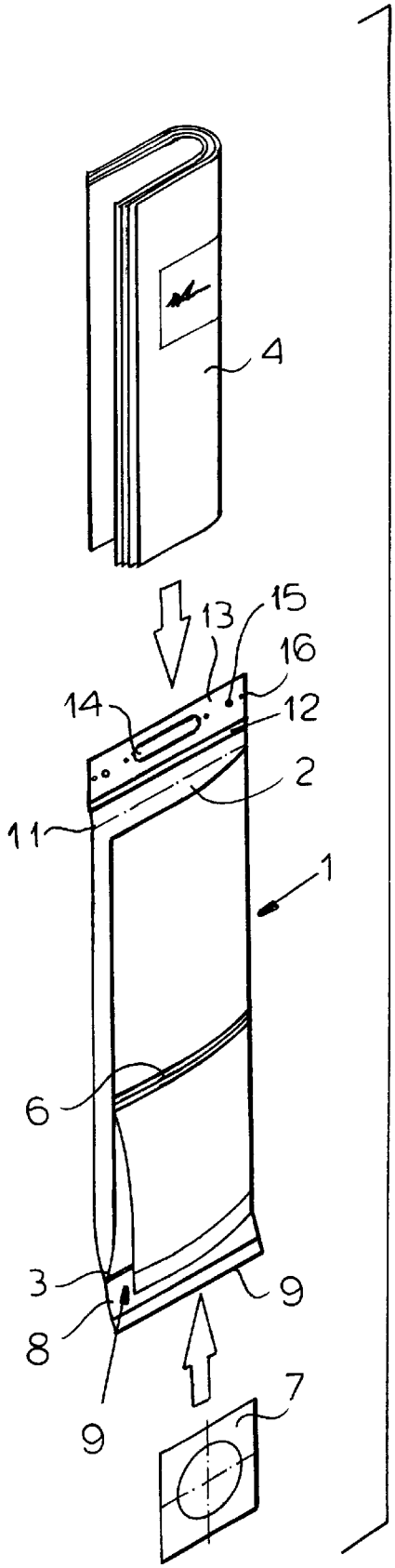
FIG. 1 is a diagrammatic perspective view of a newspaper bag separated from its stack for receiving a newspaper and a diskette.
Figures 2A, 2B, 2C, 2D:
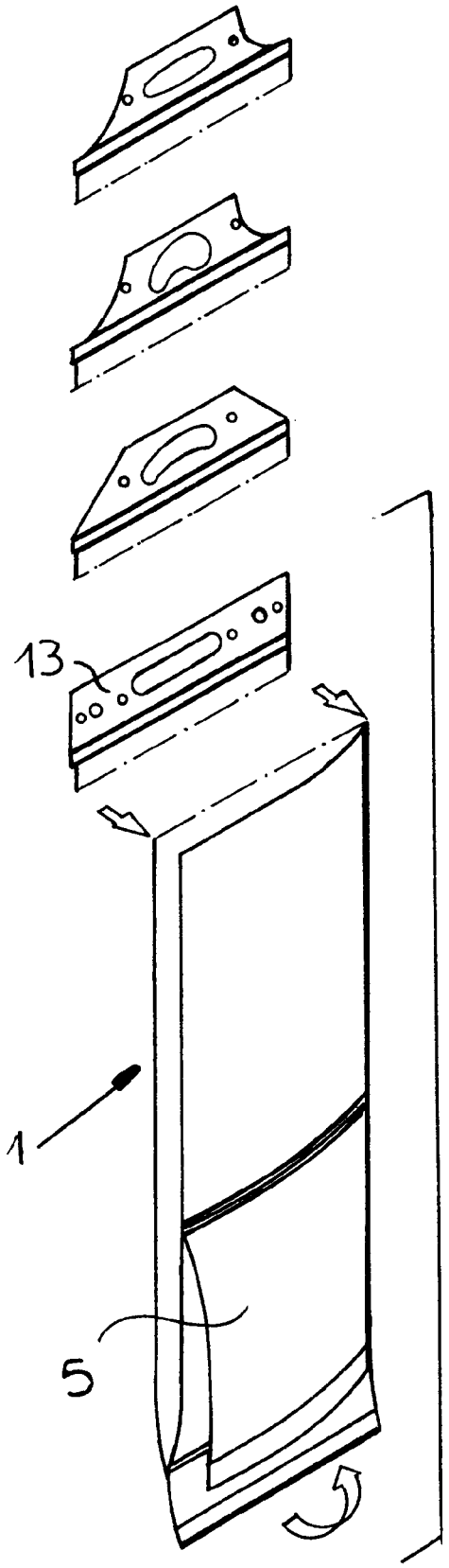
FIGS. 2*a*–2*d* are fragmentary perspective views of various variants in the suspension area of the newspaper bag.

The plastic foil bag 1 represented in FIG. 1 has at its upper end an insertion opening 2 for the bag, which extends all the way to a lower bottom seam 3 of the bag and serves for instance for receiving a newspaper 4, a magazine or the like.

In the lower area of the bag 1 a pocket 5 is attached, also made of plastic, for instance of transparent plastic material and is joined by means of a fusion seam 6 with one of the bag walls of bag 1. This pocket serves as an advertisements pouch and makes possible for instance the insertion of a diskette 7, as indicated in FIG. 1. A closing flap 8, which can be an extension of the bag 1, as shown in FIG. 1, is provided for closing the pocket 5. However the flap can also be an offset excess of the pocket material. In any case the flap is provided with an adhesive strip 9, so that it can be closed at the lower end after the insertion of the diskette. When not in use, the adhesive strip 9 can be covered by a nonillustrated protection strip.

Figure 3:
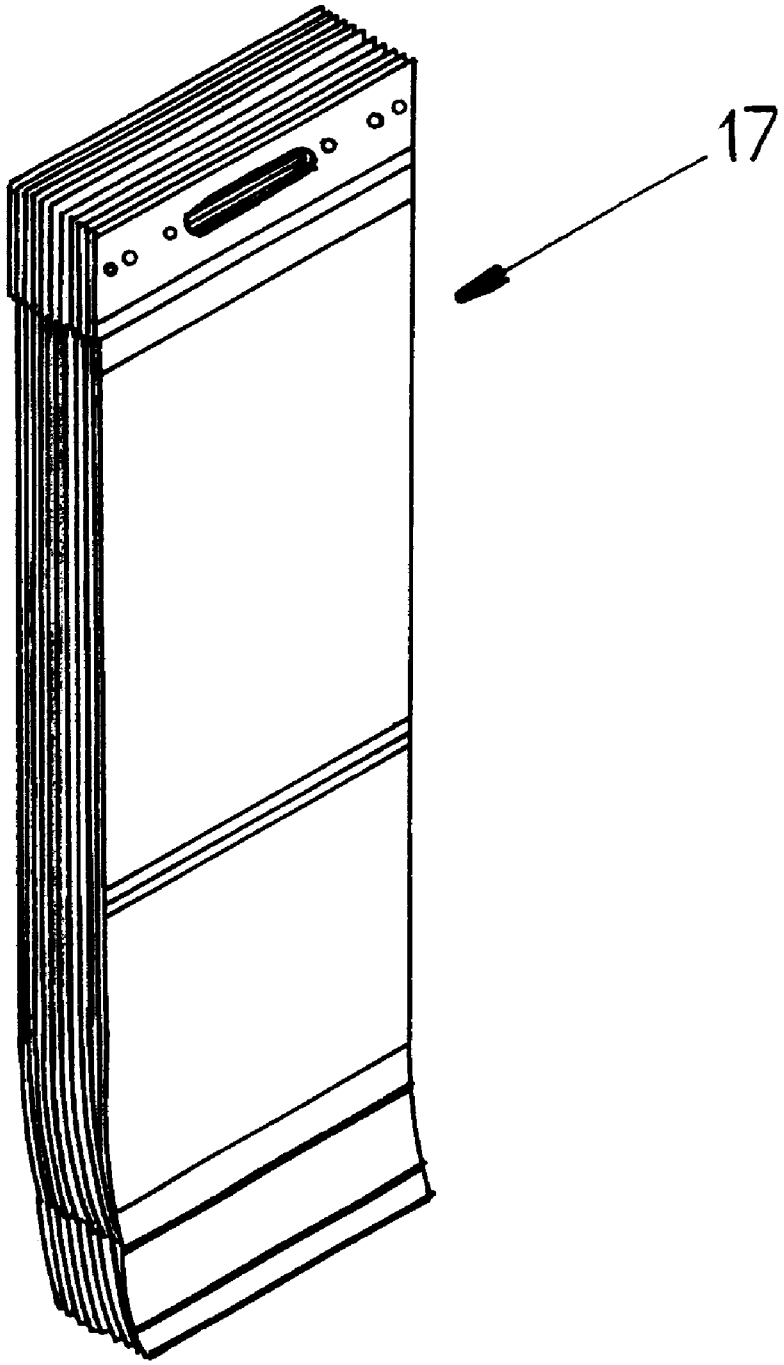
FIG. 3 a perspective view of a stack composed of several bags according to FIG. 1.

At the upper end, i.e. in the area of the insertion opening 2, in the rear wall of the bag there is a perforation line 11. Basically parallel to this perforation line a suspension element in the form of a plastic strap or strip 13 is joined via a fusion seam. This strap 13 has a suspension opening 14 as well as optional openings 15 for stacking pins and interlocking points 16. Via the latter several bags are incorporated in a stack, as indicated in FIG. 3.

In FIGS. 2*a*–2*d* various suspension openings of the suspension elements 13 are shown. The selected configuration corresponds to use and suitability. It is possible to select the shape of the suspension elements according to need and/or also to select the corresponding strength of the material.

Figure 4A:
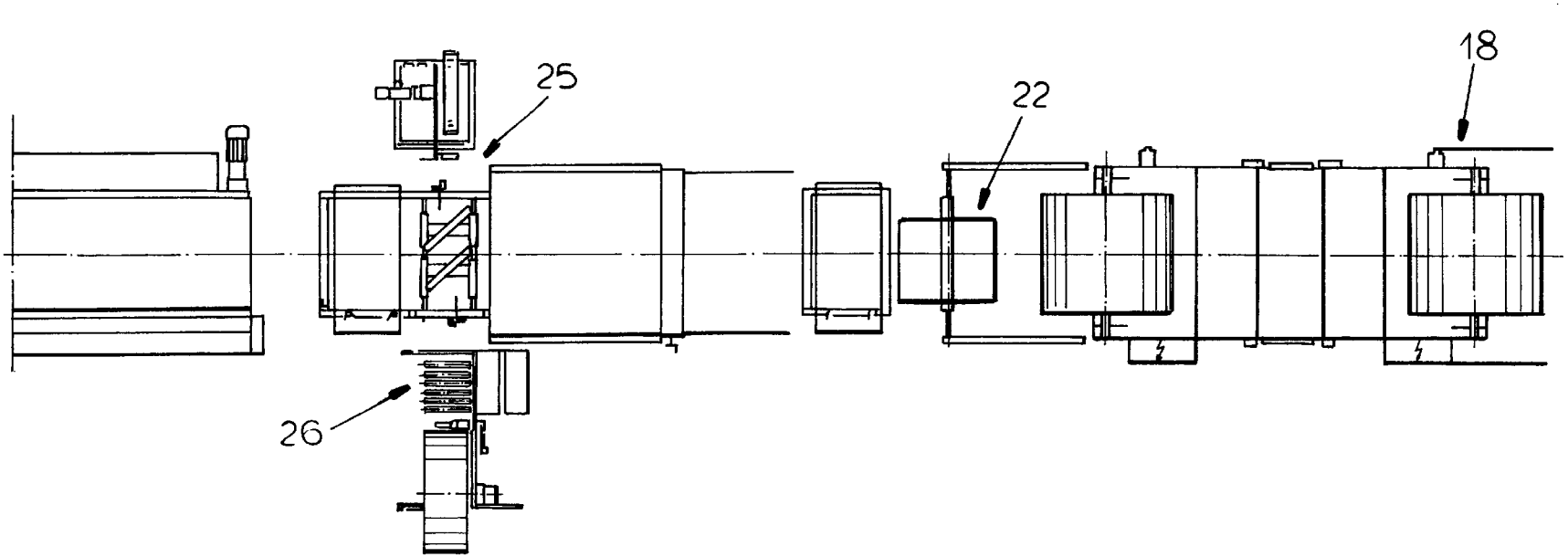
FIGS. 4*a* and 4*b* are top views showing diagrammatically an apparatus for producing newspaper bags.
Figure 5A:
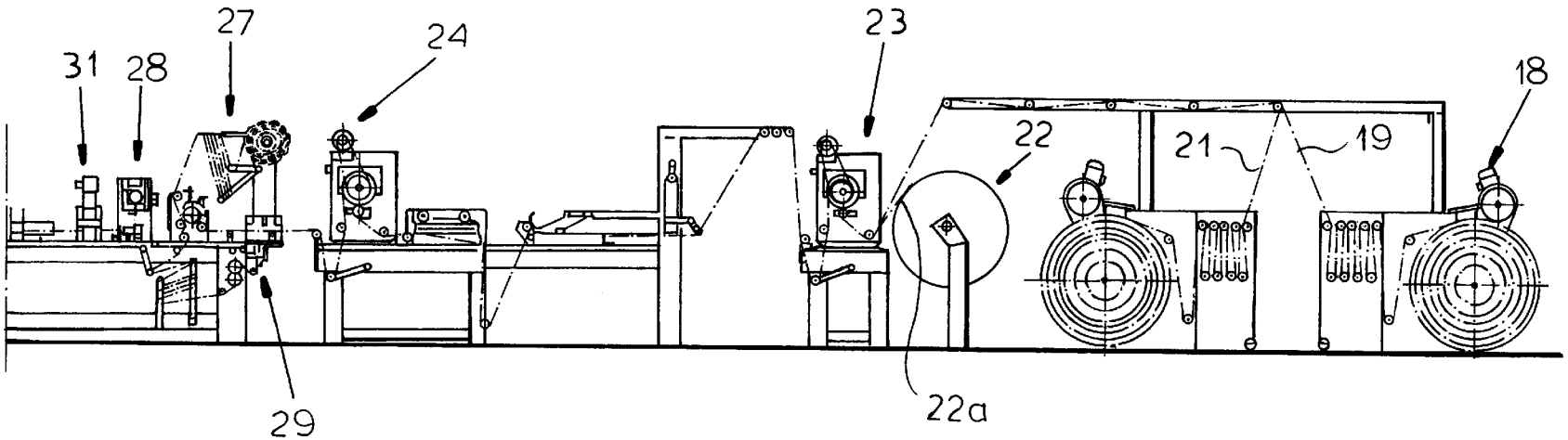
FIGS. 5*a* and 5*b* are the side views corresponding to FIGS. 4*a* and 4*b,* respectively.

FIGS. 4*a* and 5*a* show an unwinding station 18 for unwinding a first web 19, a second web 21 for producing the bags, as well as an unwinding device 22 for web material 22*a* not shown in detail for producing the pocket 5. For producing the corresponding longitudinal fusion seams the webs are passed along a first longitudinal fusion device 23, as well as a second longitudinal fusion device 34. Further with 25 an additional unwinder 25 for the strap strip is marked, which is not shown in detail in FIGS. 4*a* and 5*a*. A strip guide 26 is provided along with an adhesive-strip unwinder 27 and a glue-applying station 28. Additionally underneath the adhesive strip unwinder there is also a longitudinal perforation device 29, and if required a grip-hole punching device 31.

Figure 4B:
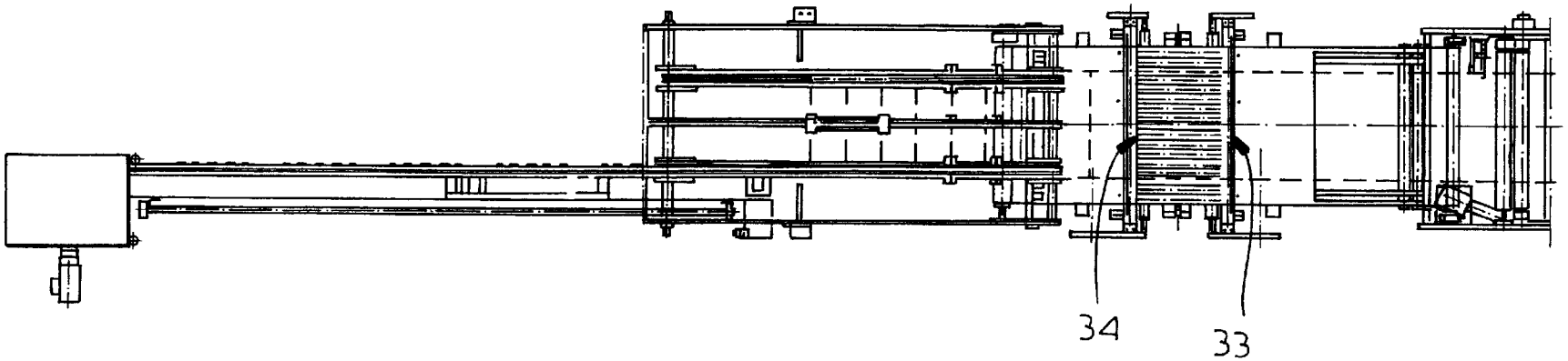
Figure 5B:
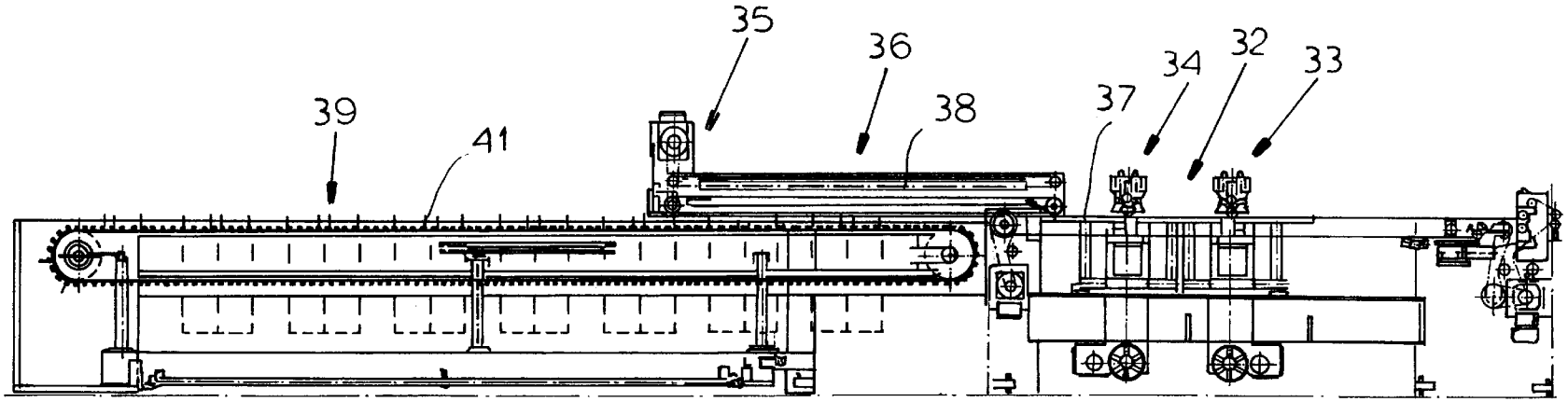

For the further production of the bags of the invention, the machine part shown in FIGS. 4*b* and 5*b* is to be considered. Essential for the invention is a transverse fusion separating device 32, which has two fusion tools 33, 34 arranged substantially transversely with respect to the travel direction of the webs, which are synchronized in their up and down motion, the distance between them being twice the width of a bag segment of the plastic foil web. In this way with each stroke or cycle two bags can be produced. A possible mechanized placement of the bags, or the pocket is feasible in practice, but is not shown here.

In support of the comparatively high cycling speed of at least 100 to 125 cycles per minute, downstream of the transverse fusion separator 32 a collection device 35 is arranged, which is subsequently described in greater detail. The collection device has first a transport device 36 which on one side extends up to a guide table 37, respectively guide belts in the area of the transverse fusion separator 32. The transport device 36 has endless holding belts 38 revolving about guide rollers. The holding belts can be provided with transport pins which can penetrate the border area of the bags during bag advancement. The bags can thus be transported to a pin-type stacking conveyor 39 which at least partially lies underneath the transport device 36. By means of a take-down device not shown in detail the bags on the stacking pins 41 can be knocked off and collected in stacks. Before the stacked bags are taken off in packages, they are interlocked in packages by an interlocking device not shown in the drawing.

Figure 6:
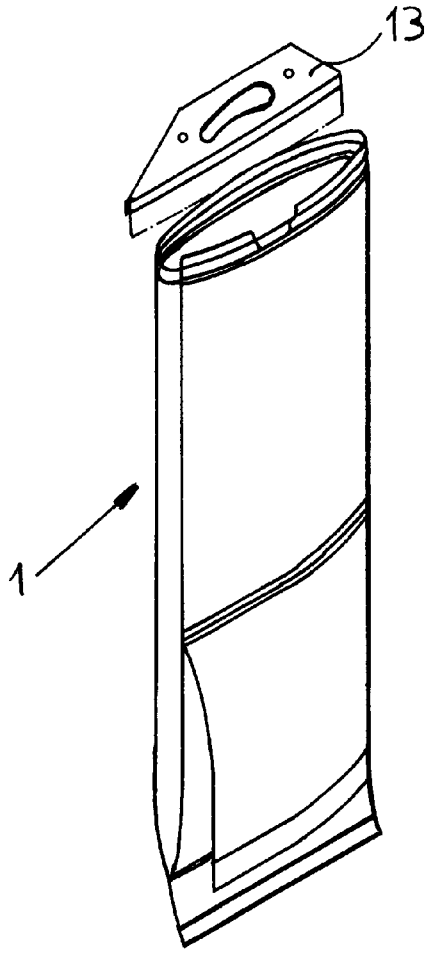
Figure 7:
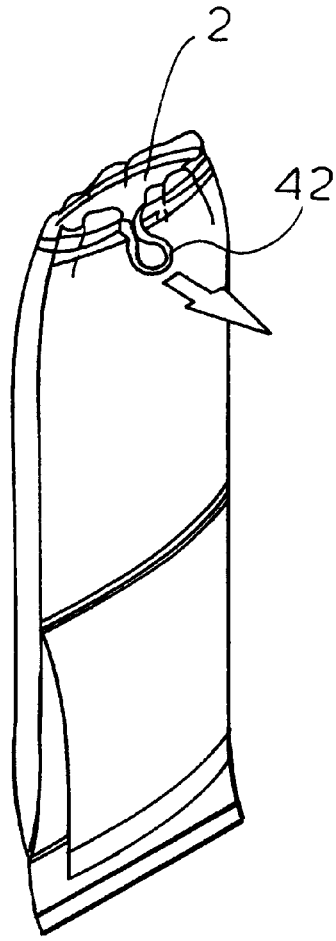

FIGS. 6 and 7 show bags designed as so-called drawstring bags. Such a bag, after it has been torn off from the stack 17, can be closed at the insertion opening 2 by a drawstring 42.

A further alternative is shown in FIGS. 8 to 10. There the bag 1 can be closed at its insertion opening 2 by a rain flap 43 provided with an adhesive strip 44.

We claim:

1. A stack of newspaper bags comprising:

a plurality of elongated plastic foil pouches each having a pair of sides, an insertion opening at one end through which a newspaper is insertable into a respective pouch and a closed end opposite said insertion opening;

a respective suspension element affixed to only one of said sides of each pouch at said one end and detachable from the respective pouch, said suspension elements being interconnected to retain said pouches in said stack and being formed with aligned suspension openings proximal to said insertion openings;

a respective pocket separate from and welded onto one of the sides of each pouch and having a mouth for receiving an article and opening in a direction away from said one end; and a respective closing flap formed as an extension of the respective pouch and foldable over said mouth to close the respective pocket after insertion of the article therein.

2. The stack of bags defined in claim 1 wherein each of such suspension elements is a tear-off segment separated from a respective side of the respective pouch by a perforation line.

3. The stack of bags defined in claim 2 wherein the tear-off segment is formed by a separate strap fused with the respective side of the respective pouch in an area of the respective insertion.

4. The stack of bags defined in claim 3, further comprising a drawstring at each of said insertion openings for closing same.

5. The stack of bags defined in claim 3, further comprising a rain protection flap for each of said pouches and having an adhesive strip for closing the respective insertion opening.

6. The stack of bags defined in claim 3 wherein said flap is on the same site of the respective pouch as the suspension element.

7. The stack of bags defined in claim 3 wherein said flap is provided with adhesive strip covered by a masking layer.

* * * * *